US011427024B2

(12) United States Patent
Freudenberg

(10) Patent No.: US 11,427,024 B2
(45) Date of Patent: Aug. 30, 2022

(54) METHOD AND DRYER SYSTEM FOR DRYING A FLUID MIXTURE

(71) Applicant: Canon Production Printing Holding B.V., Venlo (NL)

(72) Inventor: Frank Freudenberg, Rattenkirchen (DE)

(73) Assignee: Canon Production Printing Holding B.V., Venlo (NL)

( * ) Notice: Subject to any disclaimer, the term of this patent is extended or adjusted under 35 U.S.C. 154(b) by 308 days.

(21) Appl. No.: 16/811,317

(22) Filed: Mar. 6, 2020

(65) Prior Publication Data

US 2020/0282758 A1 Sep. 10, 2020

(51) Int. Cl.
*B41M 7/00* (2006.01)
*B41J 11/00* (2006.01)
*F26B 25/22* (2006.01)

(52) U.S. Cl.
CPC ..... *B41M 7/009* (2013.01); *B41J 11/002* (2013.01); *B41J 11/0022* (2021.01); *B41J 11/00216* (2021.01); *F26B 25/22* (2013.01)

(58) Field of Classification Search
CPC ..... F26B 25/22; B41M 7/009; B41J 11/0022; B41J 11/00216; B41J 11/002
USPC ..... 34/427
See application file for complete search history.

(56) References Cited

U.S. PATENT DOCUMENTS 3,705,819 A * 12/1972 Heller, Jr. et al. ..... F26B 3/34 34/247
5,333,395 A * 8/1994 Bulcsu ..... F26B 13/10 34/79
5,896,154 A * 4/1999 Mitani ..... B41J 11/0024 347/102
6,059,407 A * 5/2000 Komatsu ..... B41M 5/0256 347/103
6,481,118 B1 * 11/2002 De Vroome ..... F26B 13/10 101/424.1
8,756,830 B2 * 6/2014 Priebe ..... B41J 11/00216 34/616
9,096,079 B2 * 8/2015 Priebe ..... B41J 11/0022
11,040,553 B2 * 6/2021 Dedic ..... B41J 11/0022
2005/0156961 A1 * 7/2005 Silverbrook ..... B41J 11/0022 347/5

(Continued)

FOREIGN PATENT DOCUMENTS

DE 602004009528 T2 7/2008
DE 102019105912 A1 * 9/2020 ..... B41J 11/002
WO 2018143959 A1 8/2018

OTHER PUBLICATIONS

German action dated Feb. 12, 2020, for Application No. 10 2019 105912.7.

(Continued)

*Primary Examiner* — Stephen M Gravini
(74) *Attorney, Agent, or Firm* — The Webb Law Firm

(57) ABSTRACT

Thermal energy is supplied to a fluid mixture on a substrate that has a first component, for example water, and a second component, for example cosolvent, such that the proportion of the second component in the fluid mixture is increased at relatively high temperatures of the fluid mixture. It may thus be reliably produced that an optimally small quantity of the second component is located on the surface of the substrate following the drying process.

13 Claims, 4 Drawing Sheets

(56) References Cited

U.S. PATENT DOCUMENTS

| | | | | |
|---|---|---|---|---|
| 2005/0176847 | A1 | 8/2005 | Cagle | |
| 2008/0036799 | A1* | 2/2008 | Ittel | H05K 3/125 347/68 |
| 2009/0195572 | A1* | 8/2009 | Kovacs | B41J 11/0022 347/7 |
| 2014/0078217 | A1 | 3/2014 | Ingle et al. | |
| 2016/0052302 | A1 | 2/2016 | Willems et al. | |
| 2020/0282758 | A1* | 9/2020 | Freudenberg | F26B 21/10 |

OTHER PUBLICATIONS

Cheng, N. S. (2008). "Formula for viscosity of glycerol-water mixture." Industrial and Engineering Chemistry Research, 47, 3285-3288.

* cited by examiner

METHOD AND DRYER SYSTEM FOR DRYING A FLUID MIXTURE

CROSS REFERENCE TO RELATED APPLICATIONS

This patent application claims priority to German Patent Application No. 102019105912.7, filed Mar. 8, 2019, which is incorporated herein by reference in its entirety.

BACKGROUND

Field

The disclosure relates to a method and a corresponding dryer system for drying a fluid mixture, in particular in order to fix a print image printed with an inkjet printing device.

Related Art

Inkjet printing devices may be used for printing to recording media (such as paper, for example). For this purpose, one or more nozzles are used in order to fire ink droplets onto the recording medium and thus generate a desired print image on the recording medium. An inkjet printing device may comprise one or more dryer systems in order to dry the recording medium after application of the print image, and in order to thereby fix the applied ink on the recording medium.

In addition to dye particles and a solution fluid, for example water, the ink used by a printing device typically comprises at least one cosolvent, for example glycerin, in order to adjust the viscosity of the ink for use in the one or more nozzles of the printing device. While a cosolvent is advantageous for the printing process, the cosolvent may have a disadvantageous effect on properties of a print image, in particular on the wear resistance. Therefore, the cosolvent should be optimally completely removed from the surface of a recording medium that has been printed to, in particular be absorbed by the recording medium, within the scope of the drying or fixing of a print image.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1 illustrates an inkjet printing device having a dryer system according to an exemplary embodiment.

FIG. 2*a* illustrates a dryer system for an inkjet printing device according to an exemplary embodiment.

FIG. 2*b* illustrates a convection dryer for a dryer system according to an exemplary embodiment.

FIG. 2*c* illustrates a radiant dryer for a dryer system according to an exemplary embodiment.

FIG. 3*a* illustrates a characteristic diagram for the absorption rate of cosolvent according to an exemplary embodiment.

FIG. 3*b* illustrates a diagram of the absorption parameter according to an exemplary embodiment.

FIG. 3*c* illustrates a time curve plot of the temperature and the cosolvent proportion in a drying process according to an exemplary embodiment.

Figure 1:
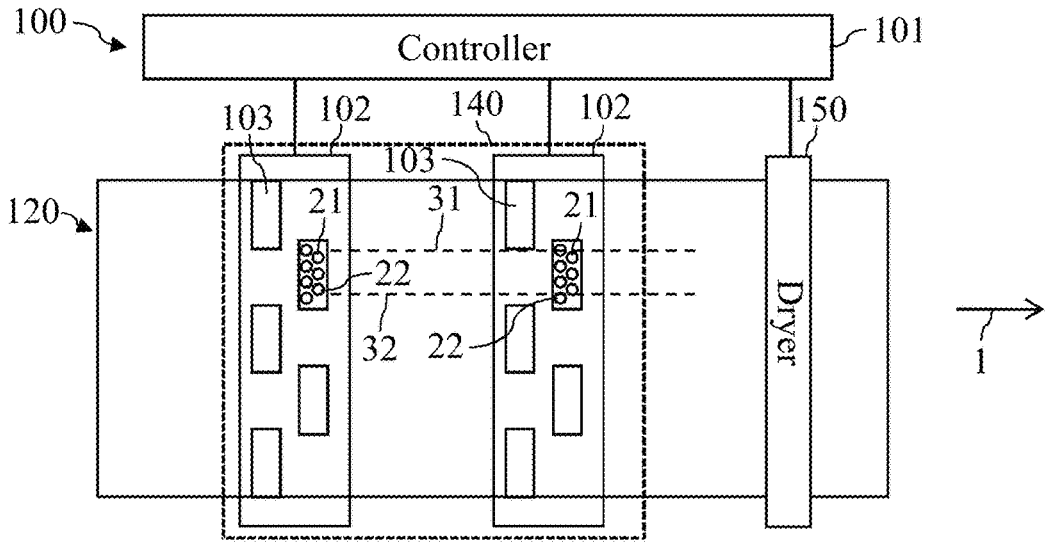

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure. However, it will be apparent to those skilled in the art that the embodiments, including structures, systems, and methods, may be practiced without these specific details. The description and representation herein are the common means used by those experienced or skilled in the art to most effectively convey the substance of their work to others skilled in the art. In other instances, well-known methods, procedures, components, and circuitry have not been described in detail to avoid unnecessarily obscuring embodiments of the disclosure.

An object of the present disclosure is to provide a dryer system and/or a method for fixing an ink-based print image, via which an optimally complete absorption of cosolvent from the ink-based print image into the recording medium that has been printed to is produced.

According to one aspect of the disclosure, a method is described for drying a fluid mixture on a surface of a substrate (in particular of a recording medium). The fluid mixture comprises a first component (for example water) having a relatively low viscosity and a second component (for example cosolvent) having a relatively high viscosity. The method is aimed at reducing a quantity of the second component remaining on the surface of the substrate following a drying process (in particular via absorption of the second component into the substrate).

In an exemplary embodiment, the method includes the supply of thermal energy to the fluid mixture, and the adaptation of the evaporation rate of the first component during the drying process, such that a temperature T of the fluid mixture on the surface of the substrate rises in a first phase up to a temperature of 65% or more (in particular to more than 65% and less than 100%) of a boiling temperature $T_S$ of the first component, while a portion g of the second component in the fluid mixture on the surface of the substrate increases, starting from an initial fraction, by at most 30 percentage points or less, in particular by 15% or less (for example increases between 10 percentage points and 30 percentage points). Furthermore, the supply of thermal energy and the adaptation of the evaporation rate take place such that the temperature T of the fluid mixture is at 65% or more (in particular at more than 65% and less than 100%) of the boiling temperature of the first component in a second phase of the drying process, whereas the portion g of the second component in the fluid mixture is increased to 95% or more. In the second phase, a drying method is thereby preferably used via which a relatively low evaporation rate of the first component is produced, in particular in order to increase the portion of the duration of the second phase in the overall drying duration. In different phases of a drying process, different evaporation rates and/or different drying methods are thus used in order to produce an optimally complete absorption of the second component by the substrate.

According to a further aspect, a dryer system is described for drying a fluid mixture on the surface of a substrate, wherein the fluid mixture comprises a first component having a relatively low viscosity and a second component having a relatively high viscosity. In an exemplary embodiment, the dryer system is configured to supply thermal energy to the fluid mixture during the drying process, and to thereby adapt the evaporation rate of the first component such that the temperature of the fluid mixture and the proportion of the second component in the fluid mixture on the surface of the substrate are adjusted for a minimum fraction of time out of the total drying duration of the drying process such that an absorption parameter for the second component is above a minimum value. In an exemplary embodiment, the absorption parameter thereby depends on $$\frac{g}{\sqrt{\eta(T, g)}},$$

wherein g indicates the proportion of the second component in the fluid mixture on the surface of the substrate, wherein T indicates the temperature of the fluid mixture on the surface of the substrate, and wherein η(T, g) indicates the viscosity of the fluid mixture on the surface of the substrate.

According to a further aspect, a printing device is described, in particular an inkjet printing device, that comprises the dryer system described in this document.

FIG. 1 illustrates a printing device (printer) 100 according to an exemplary embodiment. In an exemplary embodiment, the printing device 100 is configured to print to a recording medium 120 in the form of a sheet or page or plate or belt. The recording medium 120 may be produced from paper, paperboard, cardboard, metal, plastic, textiles, a combination thereof, and/or other materials that are suitable and can be printed to. The recording medium 120 is directed along the transport direction 1 (represented by an arrow) through the print group 140 of the printing device 100.

In the depicted example, the print group 140 of the printing device 100 comprises two print bars 102, wherein each print bar 102 may be used for printing with ink of a defined color (for example black, cyan, magenta, and/or yellow, and if applicable, Magnetic Ink Character Recognition (MICR) ink). Different print bars 102 may be used for printing with respective different inks. Furthermore, the printing device 100 typically comprises at least one fixing or dryer system that is configured to fix or dry a print image printed on the recording medium 120.

A print bar 102 may comprise one or more print heads 103 that, if applicable, are arranged side by side in a plurality of rows in order to print the dots of different columns 31, 32 of a print image onto the recording medium 120. In the example depicted in FIG. 1, a print bar 102 comprises five print heads 103, wherein each print head 103 prints the dots of one group of columns 31, 32 of a print image onto the recording medium 120.

In the embodiment depicted in FIG. 1, each print head 103 of the print group 140 comprises a plurality of nozzles 21, 22, wherein each nozzle 21, 22 is configured to fire or eject ink droplets onto the recording medium 120. A print head 102 of the print group 140 may, for example, comprise multiple thousands of effectively utilized nozzles 21, 22 that are arranged along multiple rows transversal to the transport direction 1 of the recording medium 120. By means of the nozzles 21, 22 of a print head 103 of the print group 140, dots of a line of a print image may be printed on the recording medium 120 transversal to the transport direction 1, meaning along the width of the recording medium 120.

In an exemplary embodiment, the printing device 100 includes a controller 101 (e.g. an activation hardware and/or a processor) that is configured to control the actuators of the individual nozzles 21, 22 of the individual print heads 103 of the print head 140 in order to apply the print image onto the recording medium 120 depending on print data. In an exemplary embodiment, the controller 101 includes processor circuitry that is configured to perform one or more functions and/or operations of the controller 101, including controlling the actuators of the individual nozzles and/or controlling the overall operation of the printing device 100.

The print group 140 of the printing device 100 thus comprises at least one print bar 102 having K nozzles 21, 22 that may be activated with a defined line clock cycle in order to print a line, said line traveling transversal to the transport direction 1 of the recording medium 120, with K pixels or K columns 31, 32 of a print image onto the recording medium 120, for example with K>1000. In the depicted example, the nozzles 21, 22 are installed immobile or fixed in the printing device 100 (meaning that the one or more print heads 103 remain at a fixed position during the printing operation), and the recording medium 120 is directed past the stationary nozzles 21, 22 with a defined transport velocity.

As presented above, the printing device 100 may comprise a dryer system 150 that is configured to dry the recording medium 120 after application of the ink by the one or more print bars 102, and therefore to fix the applied print image onto the recording medium 120. For this, the dryer system 150 may be controlled by a controller 101 of the printing device 100. For example, the drying may take place depending on the quantity of applied ink and/or depending on a type of the recording medium 120.

Figure 2A:
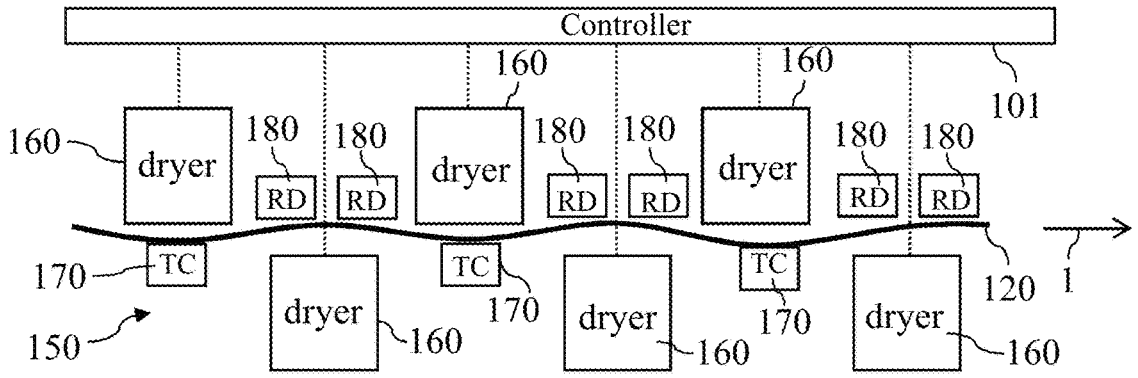

The dryer system 150 according to an exemplary embodiment presented in FIG. 2*a* comprises a plurality of dryers 160, 170, 180 that are arranged along a drying route on both sides of the recording medium 120, for example a recording medium 120 in the form of a web. In particular, the dryer system 150 may comprise one or more convection dryers 160 that are respectively configured to blow a gaseous drying medium, typically heated air, onto the surface of the recording medium 120. The print image on a recording medium 120 may thus be gently and reliably dried along the drying route of the dryer system 150. If applicable, the drying energy and/or the drying performance of the individual dryers 160 may thereby be adjusted.

Figure 2B:
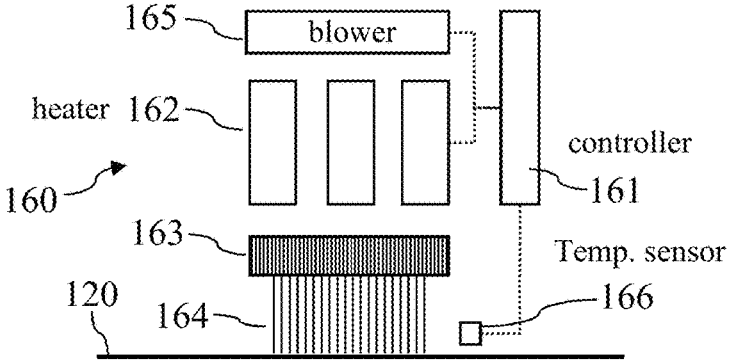

FIG. 2*b* shows a block diagram with examples of components of a convection dryer 160 according to an exemplary embodiment. The convection dryer 160 depicted in FIG. 2*b* comprises a blower 165 with which a gaseous medium, in particular air, may be directed past one or more heating elements 162. The drying medium 164 heated by the heating elements 162 is then blown via one or more openings or nozzles 163 onto the surface of the recording medium 120. The delivery rate of the blower 165, and/or the heating power of the one or more heating elements 162, may be controlled or regulated and/or individually set via a controller 161 of the dryer 160, wherein the controller 161 may, if applicable, be part of the controller 101 of the dryer system 150 or of the printing device 100. In particular, the temperature in the surroundings of the recording medium 120 may be detected by means of a temperature sensor 166.

The controller 161 may be configured to control or regulate the blower 165 and/or the one or more heating elements 162 depending on sensor data of the temperature sensor 166. For example, a defined temperature in the surroundings of the recording medium 120 may thus be set. In an exemplary embodiment, the controller 161 includes processor circuitry that is configured to perform one or more functions and/or operations of the controller 161.

A drying by means of a forced convection may thus be used to dry the recording medium 120. The drying by means of convection typically leads to a relatively rapid evaporation of water from the ink-based print image to be fixed. As a result of this, the viscosity of the ink on the recording medium 120 typically increases, wherein the ink typically comprises ink particles, water, and at least one cosolvent. In particular, the viscosity of the fluid mixture of water and cosolvent increases. Due to the increased viscosity of this fluid mixture, the penetration of the cosolvent into the interior of the recording medium 120 may be prevented, which may lead to the situation that a relatively large quantity of cosolvent continues to be located on the surface of the recording medium 120 after conclusion of the fixing or drying. The wear resistance of the fixed print image may thereby be negatively affected, for example. Furthermore, the adhesion of stacked, printed recording media 120 may occur.

In an exemplary embodiment, the dryer system 150 depicted in FIG. 2*a* also comprises one or more radiant dryers 180 that are configured to expose the print image to be fixed with radiation, for example with infrared radiation. The exposure leads to a heating of the ink and of the recording medium 120. The evaporation rate of the water from the ink is thereby typically relatively slow in comparison to the evaporation rate given a convection dryer 160.

Figure 2C:
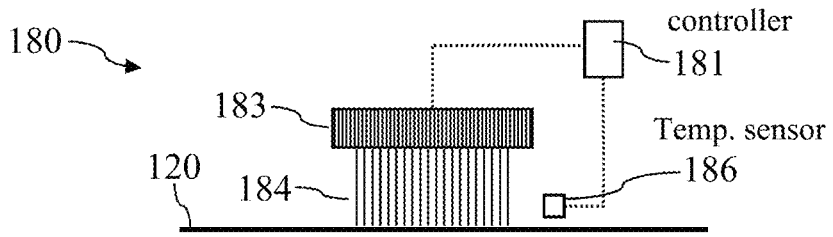

FIG. 2*c* shows an example of a radiant dryer 180, according to an exemplary embodiment, having a radiation source 183 that is configured to generate radiation 184 (for example infrared (IR) radiation) to expose the recording medium 120. The radiation source 183 may comprise one or more light emitting diodes (LEDs), for example. The dryer 180 may comprise a temperature sensor 186. Furthermore, the dryer 180 may comprise a controller 181 that is configured to operate the radiation source 183 depending on the sensor data of the temperature sensor 186. For example, the intensity and/or the spatial distribution and/or the spectrum of the radiation 184 may be varied. In an exemplary embodiment, the controller 181 includes processor circuitry that is configured to perform one or more functions and/or operations of the controller 181.

Furthermore, the dryer system 150 depicted in FIG. 2*a* comprises one or more thermal conductivity dryers 170 that are configured to heat the recording medium 120 from the (unprinted) back side. A thermal conductivity dryer 170 comprises a heated heating surface or a heating saddle over which the back side of the recording medium 120 is directed in order to heat said recording medium 120. The recording medium 120 thereby contacts the heating saddle or the heating surface. A thermal conductivity dryer 170 has an evaporation rate that is relatively low in comparison to the evaporation rate given a radiant (convection) dryer 180.

In an exemplary embodiment, a dryer system 150 includes different types of dryers 160, 170, 180 having different evaporation rates for the water in the ink applied onto a recording medium 120. Via the use of different types of dryers 160, 170, 180, the drying process of an ink-based print image may be adjusted such that, within the scope of the drying process, an optimally high proportion of cosolvent diffuses out of the ink, into the interior of the recording medium 120, and thus a qualitatively high-grade and in particular wear-resistant fixed print image may be provided. Furthermore, the length of the drying route that is required for the fixing of a print image may be reduced via the use of different types of dryers 160, 170, 180.

Figure 5:
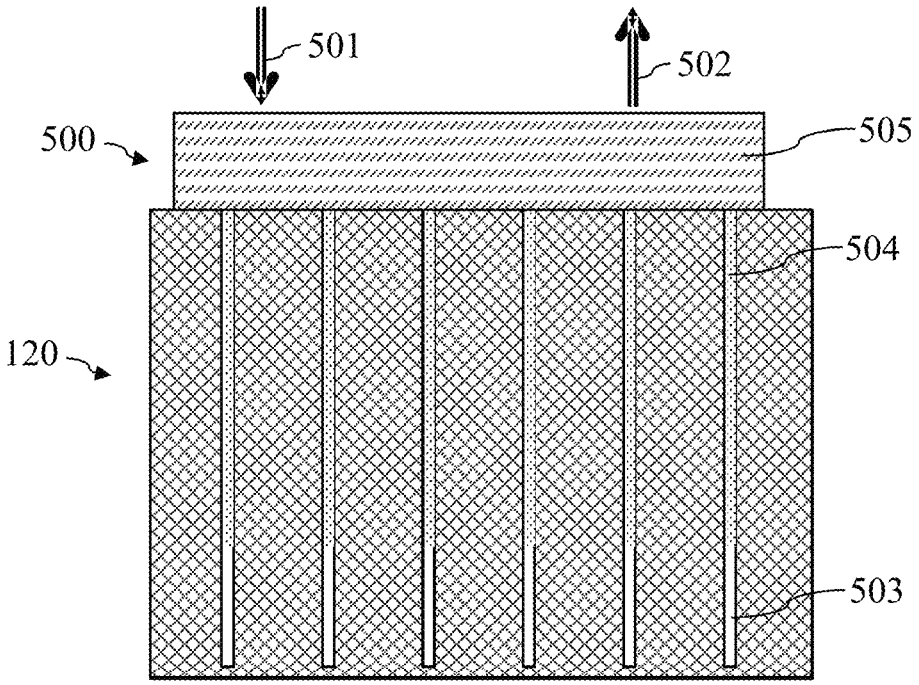
FIG. 5 illustrates an absorption model according to an exemplary embodiment.

FIG. 5 shows an example of a recording medium 120 having an ink layer 500 (for example as part of an ink-based print image). The ink layer 500 comprises a fluid mixture 505 of cosolvent and water, as well as solids (in particular dye particles). The recording medium 120 has pores 503 into which fluid 504 from the ink film 500 is absorbed. Within the scope of the drying process, thermal energy 501 is supplied to the ink layer 500 and/or the recording medium 120. On the other hand, thermal energy 502 is drawn from the ink layer 500 due to the evaporation of water from the fluid mixture 505 (in particular given use of a convection dryer 160).

In an exemplary embodiment, the mass m per area A, meaning m*, of fluid mixture 505 that is absorbed from the ink layer 500 by a recording medium 120 with pores 503 may be specified, using the Lucas-Washburn equation, as $$m/=(t)=\rho K\sqrt{T}$$

wherein K is an absorption factor with $$K=\Phi\sqrt{\frac{r\sigma_{LG}\cos\theta}{2\langle\eta\rangle}},$$

wherein ρ is the density of the fluid mixture 505, wherein Φ is the porosity of the recording medium 120 (in particular as a volume of capillaries in comparison to the volume of the recording medium 120), wherein r is the radius of a pore 503, wherein $\sigma_{LG}$ is the surface tension of the fluid mixture 505, and wherein θ is a contact angle between the fluid mixture 505 and the recording medium 120. η is the viscosity of the fluid mixture 505 in the ink layer 500.

The viscosity η of the fluid mixture 505 in the ink layer 500 typically depends on the temperature T of the fluid mixture 505 and/or on the mixture ratio g of water and cosolvent in the fluid mixture 505. g is thereby the mass fraction of cosolvent in the fluid mixture 505 of water and cosolvent in the ink layer 500, wherein g=0 stands for a mixture 505 made of pure water and wherein g=1 stands for a mixture 505 made of pure cosolvent.

In an exemplary embodiment, the viscosity of the mixture 505 of water and cosolvent may be written, via an interpolation formula (according to Cheng, N. S. (2008), "Formula for viscosity of glycerol-water mixture", Industrial and Engineering Chemistry Research, 47, 3285-3288), as $$\eta(T,g)-\eta_{water}(T)^{\alpha}\cdot\eta_{Cosolvent}(T)^{1-\alpha}$$

wherein the mixing factor α depends on the mixture ratio g. Furthermore, the mixing factor α typically depends on the temperature T and/or on the composition of the cosolvent. For glycerin as a cosolvent, for example, it results that $$\alpha=(1-g)+\frac{a\cdot b\cdot g\cdot(1-g)}{a\cdot g+b\cdot(1-g)}$$

$$a=0.705-0.0017\cdot T\ (T=\text{temperature in }^{\circ}\text{ C.})$$

$$b=(4.9+0.036\cdot T)\cdot a^{2.5}$$

-continued $$\eta_{Water}(T) = 0.00179 \cdot \exp\left(\frac{(-1230 - T) \cdot T}{36100 + 360 \cdot T}\right) \cdot \text{Pa} \cdot \text{s}$$

$$\eta_{Glycerin}(T) = 12.1 \cdot \exp\left(\frac{(-1233 + T) \cdot T}{9900 + 70 \cdot T}\right) \cdot \text{Pa} \cdot \text{s}$$

From the aforementioned Lucas-Washburn equation, it may be learned that the absorption factor is $$K \sim \frac{1}{\sqrt{\eta(T, g)}}.$$

By maximizing the absorption factor K, it may be produced that the mass m*(t) of the fluid mixture 505 of water and cosolvent is maximized. The mass of cosolvent contained therein results as g·m*(t).

As presented above, in an exemplary embodiment, the goal of the drying is to maximize the mass of cosolvent that is absorbed by the printed recording medium 120 during a drying process, in particular such that the cosolvent contained in an ink layer 500 is completely absorbed by the pores 503 of the recording medium 120. The quantity $$\frac{g}{\sqrt{\eta(T, g)}},$$

which is proportional to the mass absorption rate of cosolvent, is thus to be maximized during a drying process.

Figure 3A:
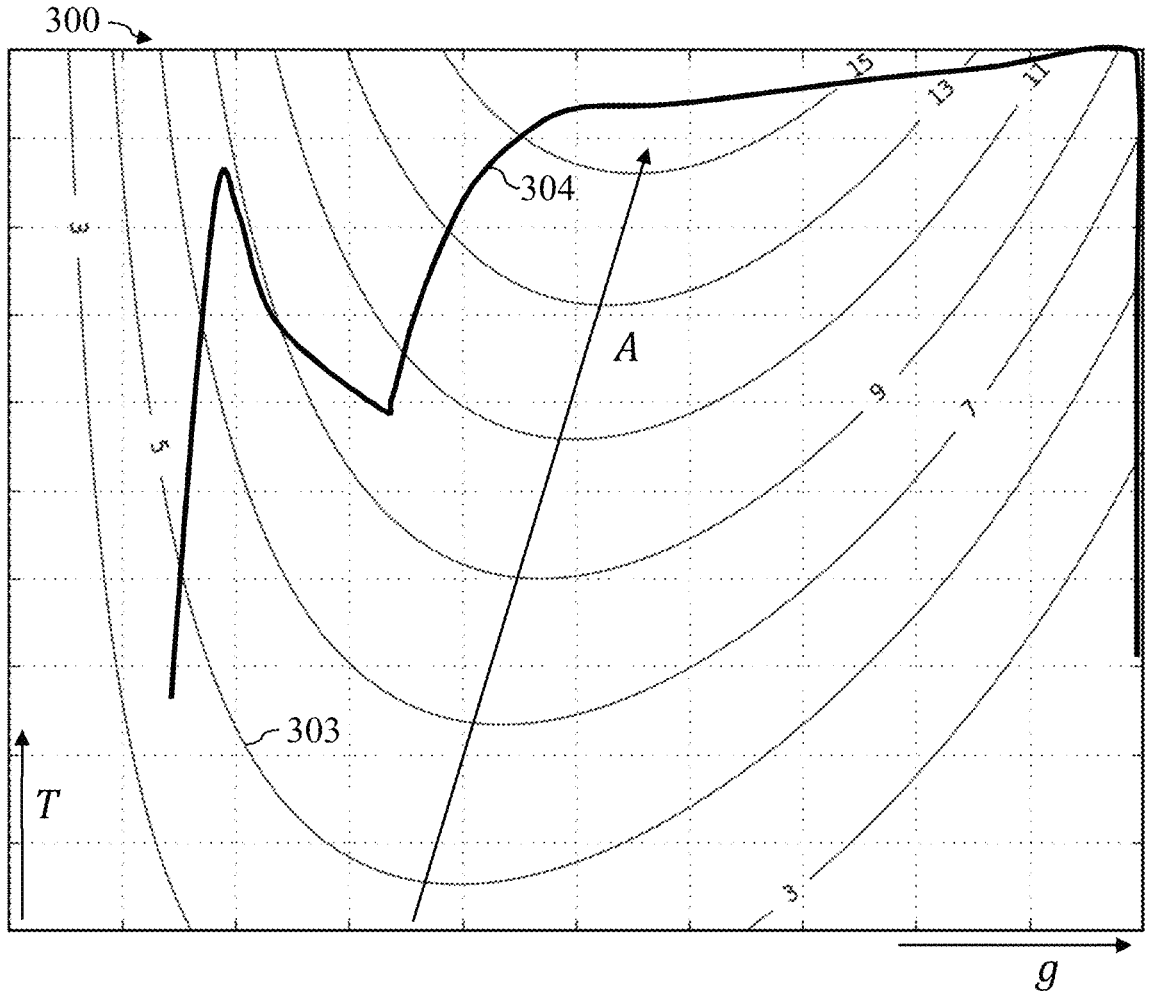

FIG. 3*a* shows an example of a characteristic diagram 300, according to an exemplary embodiment, that indicates isolines 303 for the absorption quantity $$\frac{g}{\sqrt{\eta(T, g)}}$$

(i.e. lines or the same absorption or absorption rate) for different temperatures T and different proportions g of cosolvent in the mixture 505 of water and cosolvent in an ink layer 500. Furthermore, FIG. 3*a* shows an example of a temperature/cosolvent proportion curve 304 during a drying process of an ink layer 500. The drying begins on the left side with a relatively low temperature T and a relatively low cosolvent proportion g. An increase of the temperature T of the fluid mixture 505 takes place in a first phase of the drying process (possibly without a significant alteration of the cosolvent proportion g in the fluid mixture 505 of the ink layer 500). This may be produced via a drying with a relatively low evaporation rate (for example by means of a thermal conductivity dryer 170 and/or by means of a radiant dryer 180). During the drying process, an isoline 303 of the cosolvent absorption variable $$\frac{g}{\sqrt{\eta(T, g)}}$$

with a relatively high value may thus be achieved relatively quickly. Advantageously, it may thus be achieved that the isoline 303 with a maximum value (for example of 13, 15 or more) of the cosolvent absorption variable $$\frac{g}{\sqrt{\eta(T, g)}}$$

may furthermore be achieved during the drying process.

As is to be learned from the characteristic diagram 300, the cosolvent proportion g may be increased in the further course of the drying process in order to further increase the cosolvent absorption variable $$\frac{g}{\sqrt{\eta(T, g)}}.$$

This may be produced by increasing the evaporation rate (for example by means of a convection dryer 160). However, the evaporation of water leads to the loss of thermal energy 502, and thus to a reduction of the temperature T. This temperature reduction may be counteracted in that additional thermal energy 501 is supplied (for example by means of a thermal conductivity dryer 170 and/or by means of a radiant dryer 180).

Via a suitable chronological combination of different types of dryers 160, 170, 180 or drying methods, it may thus be produced that the temperature/cosolvent proportion curve 304 of a drying process of an ink layer 500 intersects isolines 303 of the cosolvent absorption variable $$\frac{g}{\sqrt{\eta(T, g)}}$$

with optimally large values for example 13, 15 or more), and/or remains in the range of the isolines 303 of the cosolvent absorption variable $$\frac{g}{\sqrt{\eta(T, g)}}$$

with optimally large values (for example 13, 15 or more) for an optimally long time period of the drying process (i.e. in a main phase of the drying process) (as depicted in FIG. 3*a*).

The drying process is ended when the entirety of the water has evaporated from an ink layer 500, and thus the cosolvent proportion g=1. Furthermore, at the end of the drying process the cosolvent should have been optimally entirely absorbed by the recording medium 120. Within the scope of a drying process, a temperature/cosolvent proportion curve 304 thus results that begins with an initial value $g=g_a$ for the cosolvent proportion g and ends with a cosolvent proportion g=1. The temperature/cosolvent proportion curve 304 is thereby traveled in a defined total drying timer period $T_t$ of the drying process. The time portion of the total drying time period $T_t$ in which the temperature/cosolvent proportion curve 304 remains with optimally large values (for example 13, 15 or more) in the range of the isolines 303 of the cosolvent absorption variable $$\frac{g}{\sqrt{\eta(T, g)}}$$

should thereby be as large as possible in order to produce an optimally complete absorption of cosolvent from the ink layer 500 to be dried.

A drying process is thus described in which it is not sought to accelerate the absorption of fluid from an ink layer 500 via an optimally high temperature T. Rather, a drying process is designed such that the water still contained in the ink layer 500 at the beginning of a drying process is not immediately vaporized, but rather is still held in the ink layer 500 for a defined time period in order to keep the viscosity $\eta(T, g)$ of the water/cosolvent mixture low. For example, this may be produced by a heating of the ink layer 500 via radiation, via a contact heating from the back side of the recording medium 120, and/or via a hot air drying with relatively low evaporation rate. For this purpose, a hot air drying may take place with a relatively low air velocity and/or with a relatively high air temperature and/or with a relatively high humidity, for instance with water vapor.

As arises from the characteristic diagram 300, the drying may take place such that the cosolvent proportion g is held for as long as possible in a range between 40% and 70%, and the temperature T is held for as long as possible in a range between approximately 70° C. and 100° C.

One or more regions of a temperature/cosolvent proportion characteristic diagram 300 thus result that are advantageous for a drying process. In particular, it has proven to be advantageous to maintain the following parameters during a drying process (in particular for a paper-based recording medium 120 and/or for inks containing water):

temperature: $40° C. < T < 100° C.$;

optimal range of the cosolvent absorption variable $g/\sqrt{\eta(T,g)} < 13/\sqrt{Pa \cdot s}$ very good range of the cosolvent absorption variable $g/\sqrt{\eta(T,g)} < 11/\sqrt{Pa \cdot s}$ good range of the cosolvent absorption variable $g/\sqrt{\eta(T,g)} < 9/\sqrt{Pa \cdot s}$ The aforementioned ranges may typically be achieved given a medium cosolvent proportion g (for example given g between 0.3 and 0.7). Given a relatively low cosolvent proportion g (for example g=0 given pure water), the fluid mixture 505 is absorbed relatively rapidly from an ink layer 500 due to the relatively low viscosity $\eta(T, g)$ of the fluid mixture 505. On the other hand, this fluid mixture 505 contains only a relatively low cosolvent proportion g, such that only relatively little cosolvent is absorbed. On the other hand, given a relatively high cosolvent proportion g (for example g=1 given pure cosolvent), proportionally a great deal of cosolvent is in fact absorbed. However, the viscosity $\eta(T, g)$ of the fluid mixture 505 is relatively high, such that only relatively little fluid mixture 505 is absorbed.

Consequently, a range results with a cosolvent proportion g (for example g between 0.3 and 0.7) in-between which represents an advantageous (possibly optimal) compromise between a relatively low viscosity and a relatively high cosolvent proportion g in order to produce the absorption of an optimally large quantity of cosolvent.

The absorption of cosolvent is typically assisted by a relatively high temperature T. Given too high a temperature T, however, the evaporation rate of the water is so high that g relatively rapidly trends toward 100%, such that an advantageous range for the cosolvent absorption variable $$\frac{g}{\sqrt{\eta(T, g)}}$$

is not achieved at all, or is achieved only for a relatively brief time (for example for less than half a second). The drying process is therefore advantageously designed such that the temperature T and/or evaporation rate are kept low, such that a combination of temperature T and cosolvent proportion g that produces one of the aforementioned ranges of the cosolvent absorption variable is kept for an optimally long period of time.

Figure 3B:
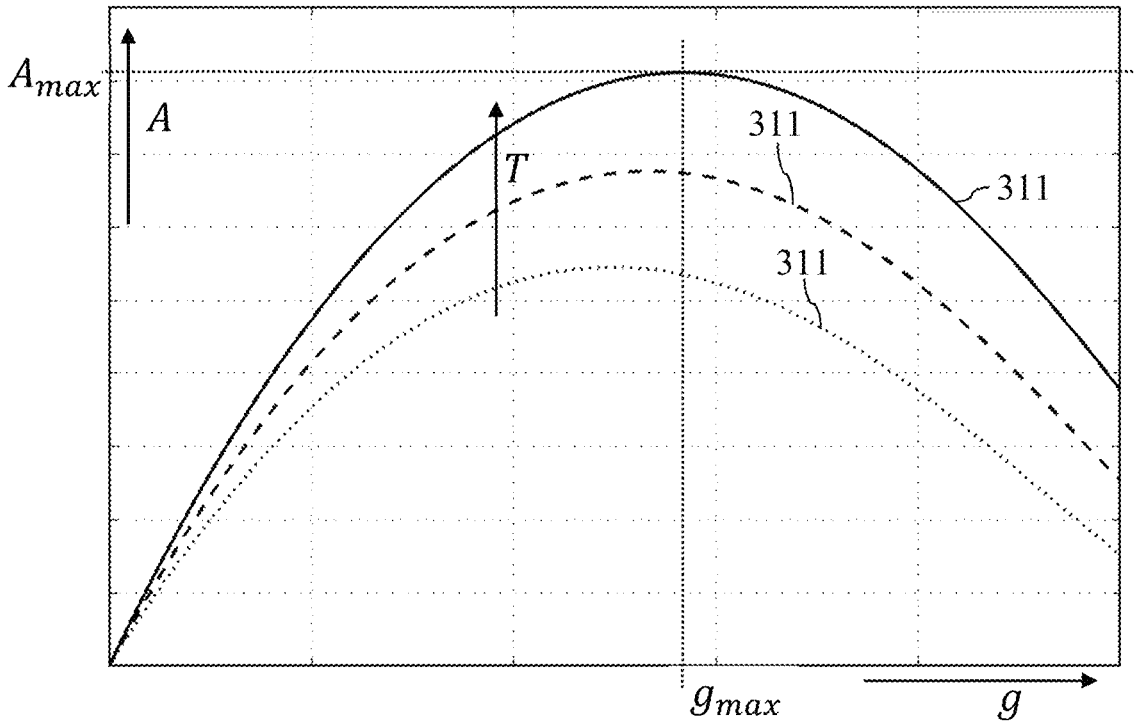

FIG. 3*b* shows an alternative depiction of the characteristic diagram 300 with different characteristic lines 311 for different temperatures T. The characteristic lines 311 respectively indicate the cosolvent absorption variable $$A = \frac{g}{\sqrt{\eta(T, g)}}$$

as a function of the cosolvent proportion g. From FIG. 3*b* it is clear that a respective maximum value of the cosolvent absorption variable A results for a defined temperature T given a medium value of the cosolvent proportion g.

Figure 3C:
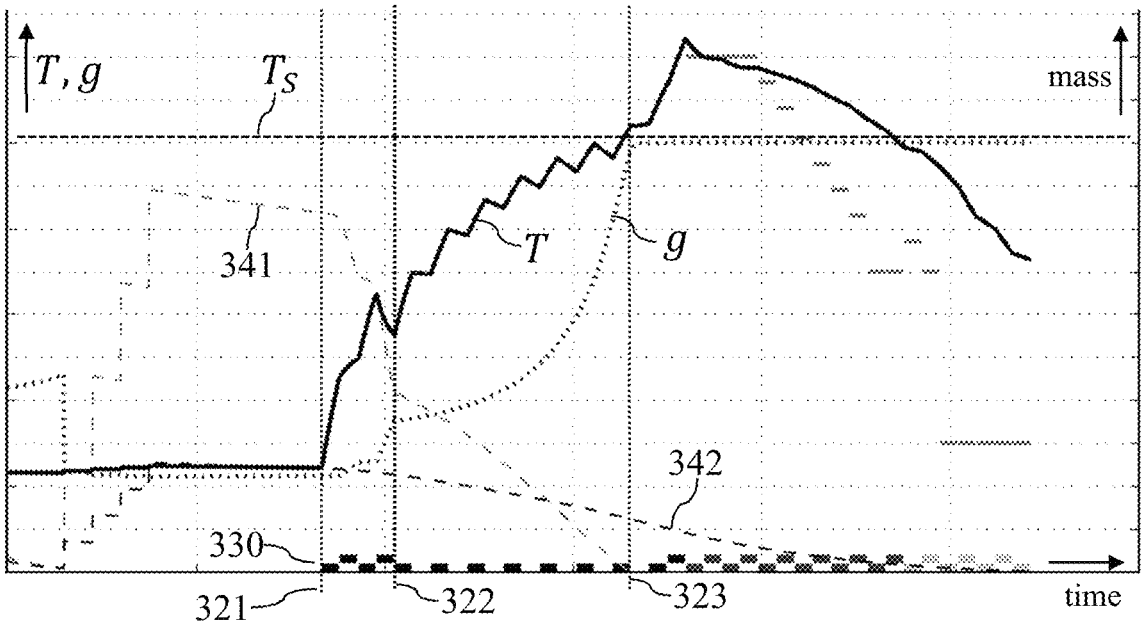

FIG. 3*c* shows examples of time curves of the temperature T and of the cosolvent proportion g given a drying process. The recording medium 120 is directed past convection dryers 160 along a drying route during the drying process. In two lines of a drying route 330, respectively as black rectangles, FIG. 3*c* illustrates dryers 160 that act on the front side of the recording medium 120 (upper line) and dryers 160 that act on the back side of the recording medium 120 (lower line). Furthermore, FIG. 3*c* illustrates the time curve of the mass 341 of water and the time curve of the mass of cosolvent 342 in the fluid mixture 505 on the surface of the recording medium 120.

The drying process begins at a starting point in time 321 with a first phase (or with a start phase) in which the temperature T of the fluid mixture 505 is increased relatively starkly and/or relatively rapidly, in particular to a temperature T that is at 65% or more of the boiling temperature $T_S$ of water (for example at 65° C. or more). On the other hand, the temperature T is preferably kept below the boiling temperature $T_S$ (in order to avoid too rapid an evaporation of the water in the fluid mixture 505). For example, a relatively stark temperature increase may be achieved via the operation of convection dryers 160 that act both on the front side and on the back side of the recording medium 120. In the first phase of the drying process, only a relatively small increase of the cosolvent proportion g thereby takes place (for example only an increase by 30 percentage points or less, or an increase by 25 percentage points or less, or by 15 percentage points or less). This may in particular be produced due to the (at least initial) relatively low temperature T of the fluid mixture 505 and the relatively low evaporation rate of water that is linked therewith.

A second phase (or a main phase) of the drying process begins at the point in time 322. In the second phase, the temperature T of the fluid mixture 505 is held at 65% or more of the boiling temperature $T_S$ of water (but preferably below the boiling temperature $T_S$ of water). Due to the evaporation of water, the cosolvent proportion g is thereby increased bit by bit to 90% or more, or to 95% or more. However, one or more measures are taken in order to keep the evaporation rate of the water as low as possible and/or in order to leave the drying process in the second phase as long as possible. In the example depicted in FIG. 3*c*, for example, in the second phase no convection dryers 160 are used that act on the front side of the recording medium 120, in order to reduce the evaporation rate of water. For example, the drying in the second phase may take place such (in particular with such a low evaporation rate of water) that the duration of the second phase is longer (in particular by a factor of 1.2 or more) than the duration of the first phase.

In a third phase (or in an end phase), a heating of the fluid mixture 505 beyond the boiling temperature $T_S$ (for example to a temperature T that is between 120% and 150% of the boiling temperature $T_S$) may then take place as of the third point in time 323. A complete evaporation of the water may thus be produced, and with this the cosolvent proportion g may be increased to 100%. Furthermore, a further absorption of cosolvent into the recording medium 120 may be produced due to the relatively high temperature T. Following the third phase, a (controlled) cooling of the recording medium 120 may then be produced.

The aspect described in this document has been described for a fluid mixture 505 of water and cosolvent in the fixing of an ink layer 500. The described aspects can generally relate to a fluid mixture 505 of a first component having a relatively low viscosity that evaporates relatively easily (for example water) and a second component having a relatively high viscosity that barely evaporates (for example cosolvent), wherein the second component should be absorbed as rapidly as possible and/or as completely as possible by a substrate 120. The absorption of the second component may be improved, in particular accelerated, in that the second component is diluted with the first component for an optimally long period of time. The aspects described specifically for water and/or cosolvent apply in general to a fluid mixture 505 having a first component and a second component.

As is clear from FIG. 3*b*, the curve of the absorption variable $$A = \frac{g}{\sqrt{\eta(T, g)}}$$

for the second component as a function of the proportion g of the second component in the fluid mixture 505 given a defined value $g_{max}$ exhibits a maximum $A_{max}$ and decreases in the direction of g=0 or g=1. For a fixing and/or drying process or absorption process, a range of g that produces a value of the absorption variable A that is below the maximum value $A_{max}$ of the absorption variable A by at most 20% may preferably be used over an optimally long time period.

Figure 4:
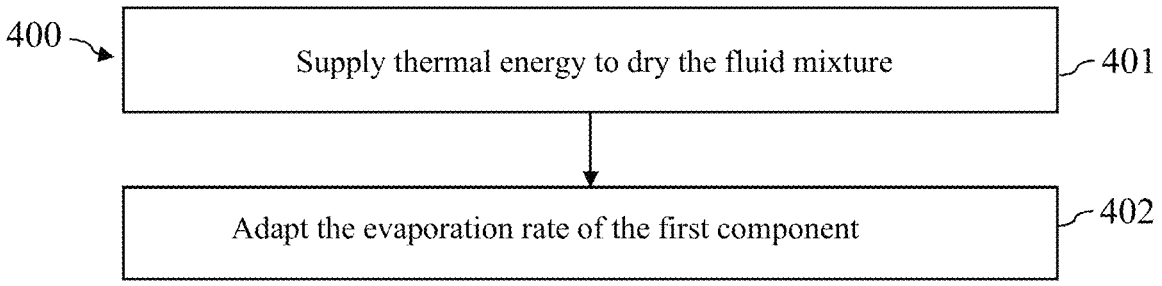
FIG. 4 illustrates a flowchart of a method for fixing and/or drying a fluid mixture according to an exemplary embodiment.

FIG. 4 shows a flowchart of a method 400 according to an exemplary embodiment for drying a fluid mixture 505 on the surface of a substrate 120, in particular on the surface of a recording medium. The fluid mixture 505 comprises a first component having a relatively low viscosity and a second component having a relatively high viscosity. The fluid mixture 505 may be part of an ink layer 500. Furthermore, the first component may comprise water and/or the second component may comprise a cosolvent (such as glycerin, for example). The method 400 may thus be aimed at drying or fixing an ink-based print image.

The first component may have a higher evaporation rate than the second component. In other words, the first component may have a tendency to volatilize more rapidly from the fluid mixture 505 (in particular given heating of the fluid mixture 505) than the second component. The evaporation rate may thereby be low, such that essentially no evaporation of the second component occurs during the drying process (for example, less than 10% or 5% of the second component evaporates during the drying process). Furthermore, the first component has a boiling temperature $T_S$. The boiling temperature $T_S$ of the first component is typically lower (in particular by a factor of 1.5 or more, 2 or more, or 3 or more) than the boiling temperature of the second component. The substrate 120 also has pores 503 that are designed to absorb the fluid mixture 505. The absorption rate thereby typically depends on the temperature T and/or on the viscosity of the fluid mixture 505.

In an exemplary embodiment, the method 400 may in particular be directed toward an optimally small proportion of the second component remaining on the surface of the substrate 120 following a drying process. For this purpose, within the scope of the method 400 it may be produced that the second component is absorbed optimally rapidly and/or proportionally to an optimally large extent by the substrate 120.

The drying process of the fluid mixture 505 may be considered to have ended if (in particular as soon as) the first component has essentially been entirely removed (for example up to 95%, or up to 99% or more) from the surface of the substrate 120. The method 400 may thus be designed to also remove the second component as completely as possible from the surface of the substrate (for example via absorption into the pores 503 of the substrate 120) in the total drying duration that is required to remove the first component from the surface of the substrate (for example via evaporation).

In an exemplary embodiment, the method 400 includes the supply 401 of thermal energy 501 to the fluid mixture 505 during the drying process. Furthermore, the method 400 includes the adaptation and/or the control 402 of the evaporation rate of the first component during the drying process. The thermal energy 501 for drying may thereby be supplied via one or more different drying methods, for example via a drying by means of a tempered drying medium 164 (for example hot air), via a drying by means of radiation 184 (for example IR radiation), and/or via heating of the back side of the substrate 120 (for example by means of a heating saddle). The different drying methods may at least in part produce different evaporation rates of the first component. Different evaporation rates of the first component may thereby be produced by the different drying methods, even given the same temperature T of the fluid mixture 505 on the surface of the substrate 120. For example, a relatively low evaporation rate of the first component may be produced via a drying by means of a tempered drying medium 164 that acts on the back side of the substrate 120, in comparison to a drying by means of a tempered drying medium 164 that acts on the front side of the substrate 120 (on which the fluid mixture 505 is located) (given the same temperature T of the fluid mixture 505).

The thermal energy 501 may be supplied such that, during the drying process, the temperature T of the fluid mixture 505 on the surface of the substrate 120 and the proportion g of the second component in the fluid mixture 505 on the surface of the substrate 120 are held at least temporarily in a value range in which an absorption variable A for the second component is above a minimum value. In particular, by adjusting the temperature T and the proportion g of the second component, it may be produced that the absorption variable A, which indicates the absorption rate of the second component, is above the minimum value for a minimum time fraction of the total drying duration of the drying process.

The absorption variable A may depend on the term $$\frac{g}{\sqrt{\eta}}$$

(or be proportional to this term). η is thereby the viscosity of the fluid mixture 505 on the surface of the substrate 120, wherein the viscosity is typically dependent on the temperature T and on the proportion g of the second component.

A method 400 according to an exemplary embodiment is thus described in which thermal energy 501 is supplied in such a way to a fluid mixture 505 on a substrate 120 that has a first component, for example water, and a second component, for example cosolvent, and the evaporation rate of the first component is thereby controlled in such a way, that the absorption variable A in particular $$A = \frac{g}{\sqrt{\eta}}\Big),$$

which depends on the proportion g of the second component in the fluid mixture 505 and on the viscosity η of the fluid mixture 505, assumes optimally high values for as long as possible during the drying process. For this purpose, in an initial phase of the drying process the absorption variable A may be brought into a relatively high value range (for example at 60% or more, 70% or more, 80% or more, or 90% or more of a maximum value $A_{max}$ of the absorption variable A). In a main phase of the drying process, the absorption variable may then be kept in the relatively high value range for as long as possible (for example for 10% or more, 20% or more, or 50% or more of the total drying duration). It may thus be reliably produced that an optimally small quantity of the second component is located on the surface of the substrate 120 following the drying process.

In other words, a method 400 for drying a fluid mixture 505 is described in which, via the adjustment or control of the evaporation rate of the first component during the drying process, the mixture ratio g of the first and second component in the fluid mixture 505 is controlled such that, during the drying process, the diluting effect of the first component is utilized (for as long as possible) to make it possible to absorb the second component as effectively as possible into the substrate 120. In adjusting or controlling the evaporation rate, care is thereby taken that the dilution of the fluid mixture 505 with the first component does not become or remain too strong, in order to avoid an unnecessarily high quantity of the first component being absorbed by the substrate 120 (and therefore the absorption capability of the substrate 120 to absorb the second component being reduced). Furthermore, in adjusting or controlling the evaporation rate, care is to be taken that the proportion of the first component does not become too low, and that the absorption of the fluid mixture 505 is not thereby inhibited. The absorption variable A, in particular $$A \sim \frac{g}{\sqrt{\eta}},$$

is thereby an indicator for in which mixture ratio g the second component is optimally effectively absorbed.

Within the scope of the drying process, thermal energy 501 may be supplied to the fluid mixture 505 such that the temperature T of the fluid mixture 505 does not exceed (but possibly reaches) a maximum temperature during the drying process (in particular during the first and second phase of the drying process). The maximum temperature (of the first and second phase of the drying process) may, for example, correspond to the boiling temperature $T_S$ of the first component. The value of the absorption variable A typically increases with increasing temperature T (at least on average). At the maximum temperature, the absorption variable A may exhibit a maximum or reference value $A_{max}$ for a defined value $g_{max}$ of the proportion g of the second component in the fluid mixture 505. The minimum value of the absorption variable A, which the minimum time portion of the total drying duration of the drying process does not fall below, may be 60% or more, 70% or more, 80% or more, or 90% or more of the maximum value $A_{max}$ of the absorption variable A. The temperature T and/or the proportion g of the second component in the fluid mixture 505 may thus be adjusted during the drying process such that the absorption variable A at least temporarily has values that are less than the maximum value $A_{max}$ of the absorption variable A by less than 40%, 30%, 20%, or 10%. A particularly reliable and comprehensive absorption of the second component may thus be produced.

The minimum proportion of the total drying duration may be 10% or more, 20% or more, or 505 or more. Via a suitable adjustment of the temperature T and/or of the proportion g of the second component in the fluid mixture 505 during the drying process, it may thus be produced that the second component is absorbed by the substrate 120 with a relatively high absorption rate during a significant proportion of the drying process.

Alternatively or additionally, the temperature T and/or the proportion g of the second component in the fluid mixture 505 may be set during the drying process such that the average value of the absorption variable A (in particular of $$\frac{g}{\sqrt{\eta}}\Big)$$

is 20% or more, 30% or more, or 40% or more of the maximum value $A_{max}$ of the absorption variable A during the entire drying process. It may thus be produced that a significant proportion of the second component is absorbed from the fluid mixture 505.

In a concrete example (for example for water as a first component, for glycerin as a second component, and for a paper-based substrate 120), the maximum value $A_{max}$ of the absorption variable A may be $15/\sqrt{\text{Pa}\cdot\text{s}}$ or more.

During the drying process, thermal energy 501 may be supplied to the fluid mixture 505 such that the proportion g of the second component in the fluid mixture 505 on the surface of the substrate 120 is increased, starting from an initial proportion at the beginning of the drying process, which is 30% or less, for example, up to a final proportion of 90% or more, or 95% or more. Within the scope of the drying, it may thus be produced that the first component is essentially entirely removed from the surface of the substrate 120.

The setting of an optimally large value of the absorption variable A during a drying process may in particular be achieved in that the evaporation rate of the first component is adapted and/or modified during the drying process. In particular, in a first phase of the drying process, a heating of the fluid mixture 505 may be produced with a relatively low evaporation rate. For example, this may be achieved via use of at least one drying method in which radiant heat 184 is used and/or in which a heating saddle (in contact with the substrate 120) is used.

Furthermore, in a second phase of the drying process, a maintenance of the temperature of the fluid mixture 505 with a relatively low evaporation rate is produced. The maintenance of the temperature of the fluid mixture 505 at a relatively low evaporation rate may, for example, be achieved with a drying method in which radiant heat 184 and/or in which a heating saddle and/or in which a drying medium 164 is used from the back side of the substrate 120. By reducing the evaporation rate during the drying process, it may be particularly reliably and efficiently produced that the absorption variable A may be held at a relatively high value for as long as possible.

During the drying process, thermal energy 501 may be supplied to the fluid mixture 505 such that, in a first phase of the drying process, the temperature T of the fluid mixture 505 rises relatively starkly, in particular up to a temperature T of 80% or more of the maximum temperature used for the drying process (for example up to a temperature T between 80% and 95% of the maximum temperature). On the other hand, thermal energy 501 may be supplied to the fluid mixture 505 such that, in the first phase, the proportion g of the second component in the fluid mixture 505 rises relatively little, in particular by 10 percentage points or less. A relatively stark rise of the temperature T and a relatively slight variation of the proportion g of the second component in the fluid mixture 505 may be produced by a drying method in which the first component has a relatively low evaporation rate (for example due to the action of radiation 184 and/or due to heating of the substrate 120 from the back side).

Furthermore, thermal energy 501 may be supplied to the fluid mixture 505 such that the temperature T of the fluid mixture 505 is varied relatively little, in particular by a maximum of 10%, whereas the proportion g of the second component in the fluid mixture 505 increases relatively starkly, in particular by 25 percentage points or more. For example, this may be produced via a drying method in which the first component has a relatively high evaporation rate (for example due to the action of a drying medium 164).

As is clear from FIG. 3*a*, the heating of the fluid mixture 505 and the increase of the proportion g of the second component are possibly inverted and/or performed in combination. For example, in a combined (initial) phase, thermal energy may be supplied with a medium evaporation rate of the first component (for example via combined action of a drying medium 164 and radiation 184 (possibly with additional heating of the substrate 120 from the back side). Via a combined implementation of the first and second phase, the aforementioned value range of the absorption variable A (for example 60%, 70%, 80%, 90% or more of the maximum value $A_{max}$ of the absorption variable A) may be achieved in an accelerated manner and/or with a shortened drying route.

In a (possibly combined) initial phase of the drying process, thermal energy 501 may thus be supplied to the fluid mixture 505 such that the temperature T of the fluid mixture 505 rises relatively starkly, in particular up to a temperature T of 80% or more of the maximum temperature used for the drying process, whereas the proportion g of the second component in the fluid mixture 505 increases, in particular by 25 percentage points or more, due to a medium evaporation rate of the first component.

Thermal energy 501 may also be supplied to the fluid mixture 505 such that, in a second phase or in a main phase of the drying process, the temperature T of the fluid mixture 505 is held at a relatively high temperature (in particular at 65% or more of the boiling temperature of the first component). The proportion g of the second component in the fluid mixture 505 may thereby be increased (given a relatively low evaporation rate of the first component), in particular to 95% or more. In the second phase, a drying method may thus be produced in which the first component has a relatively low evaporation rate (for example via action of radiation 184 and/or via heating of the substrate 120 from the back side). The second phase may thereby extend over 30% or more, 40% or more, or 50% or more of the total drying duration of a drying process. The temperature T and/or the proportion g of the second component may thereby be adjusted during the second phase such that the value of the absorption variable A is 70%, 80%, 90% or more of the maximum value $A_{max}$ of the absorption variable A.

For the drying of a fluid mixture 505 on a substrate 120, a drying route may thus be provided in which the fluid mixture 505 is subjected to different drying methods. For example, the drying route may in a first region (for the first phase of the drying process) have one or more thermal conductivity dryers 170 and/or one or more radiant dryers 180 in order to increase the temperature T of the fluid mixture 505 with a relatively low evaporation rate of the first component.

Moreover, the drying route may, in a second region (for the second phase or for the main phase of the drying process) have one or more thermal conductivity dryers 170 and/or one or more radiant dryers 180 in order to hold the temperature T of the fluid mixture 505 having a relatively low evaporation rate of the first component at a relatively high value (for example at 65% or more of the boiling temperature $T_S$ of the first component), and in order to thereby keep the value of the absorption variable A above the minimum value (for example of 70%, 80%, 90% or more of the maximum value $A_{max}$ of the absorption variable A) for as long as possible.

In a third phase, or in an end phase, the proportion g of the second component may be increased (for example up to g=1) at a relatively high temperature T (for example at 90% or more of the maximum temperature) in order to conclude the drying process. One or more convection dryers 160 may be used for this purpose.

Via a combination of different types of dryers 160, 170, 180 along the drying route, it may thus be particularly reliably produced that a second component is no longer located on the surface of a substrate 120 following the drying process.

In an exemplary embodiment, the method 400 includes the use of different drying methods for drying the fluid mixture 505 on the surface of the substrate 120 during the drying process, wherein the different drying methods have different evaporation rates for the first component. Examples of drying methods are: a drying by means of a tempered drying medium 164, a drying by means of radiation 184, and/or a drying via heating of the back side of the substrate 120. The different drying methods may thereby be used at least in part in different phases of a drying process in order to produce a time curve 304 of the combination of temperature T and proportion g of the second component for which the absorption variable A has an optimally large value (for example of 20%, 30%, 40% or more of the maximum value $A_{max}$ of the absorption variable A), averaged over time.

Alternatively or additionally, in an exemplary embodiment, during a drying process the moisture of gas in the direct environment of the fluid mixture 505 on the surface of the substrate 120 may be adapted. For example, the moisture of the drying medium 164 for drying the fluid mixture 505 during a drying process may be varied in order to vary the evaporation rate of the first component.

A method 400 for drying a fluid mixture 505, according to an exemplary embodiment, is thus described that includes supplying 401 thermal energy 501 to the fluid mixture 505 and adapting 402 the evaporation rate of the first component during the drying process. The drying process may have a plurality of different phases. In particular, in a first phase or in an initial phase of the drying process, the temperature T of the fluid mixture 505 on the surface of the substrate 120 may be increased relatively starkly, in particular up to a temperature T of 80% or more of a maximum temperature used for the drying process. Alternatively or additionally, the temperature T may be increased to 65% or more of the boiling temperature $T_S$ of the first component. Furthermore, in the initial phase, the proportion g of the second component in the fluid mixture 505 on the surface of the substrate 120 may be increased, starting from an initial proportion, up to a target proportion, in particular by 10 percentage points to 30 percentage points. The target proportion may, for example, be between 20%, 10%, or less below $g_{max}$ and $g_{max}$ (wherein the maximum value $A_{max}$ of the absorption variable A is present at the value $g_{max}$). Alternatively or additionally, the target proportion may be between 0.3 and 0.7. Alternatively or additionally, the target proportion may be at 40% or less.

Furthermore, in a second phase or in a main phase of the drying process, the temperature T of the fluid mixture 505 is varied relatively little, in particular by 10% or less. Alternatively or additionally, the temperature T of the fluid mixture 505 may be kept at 65% or more of the boiling temperature $T_S$ of the first component. In the second phase, the proportion g of the second component in the fluid mixture 505 may be increased bit by bit to 90% or more, or to 95% or more, given a relatively temperature of the fluid mixture 505. In the main phase, the absorption variable A may be kept in a relatively high value range (for example above 50% or more, 60% or more, 70% or more, or 80% or more of the maximum value $A_{max}$ of absorption variable A). The main phase may extend over 10% or more, 20% or more, or 50% or more of the total drying duration. In particular, the main phase may be longer than the initial phase. In the main phase, one or more drying methods with a low evaporation rate for the first component (in particular by means of radiation 184 and/or heating saddle) may be used. Alternatively or additionally, a drying medium 154 may be used that comprises a relatively high proportion of the first component (in particular of water).

Moreover, in an exemplary embodiment, the drying process includes an end phase (or a third phase) in which the temperature T of the fluid mixture 505 is possibly increased beyond the boiling temperature of the first component. The proportion of the first component (which corresponds to (1−g), for example) in the fluid mixture 505 may thereby be relatively starkly reduced due to a relatively high evaporation rate of the first component, in particular to 10%, 5%, or less. Furthermore, a further absorption of the second component into the substrate 120 may be produced due to the relatively high temperature T of the fluid mixture 505. In the end phase, a drying method having a relatively high evaporation rate may be used.

Furthermore, in this document a dryer system 150 for drying a fluid mixture 505 on the surface of a substrate 120 is described. The fluid mixture 505 comprises a first component (for example water) having a relatively low viscosity and a second component (for example a cosolvent) having a relatively high viscosity, wherein the first component has a higher evaporation rate than the second component.

In an exemplary embodiment, the dryer system 150 is configured to supply thermal energy 501 to the fluid mixture 505 during the drying process, and to thereby adapt or control the evaporation rate of the first component, such that the temperature T of the fluid mixture 505 and the proportion g of the second component in the fluid mixture 505 on the surface of the substrate 120 are, for a minimum time portion of the total drying duration of the drying process, kept in a value range in which the absorption variable A for the second component is above a minimum value (for example of 50%, 60%, or more of the maximum value $A_{max}$ of the absorption variable A).

Alternatively or additionally, in an exemplary embodiment, the dryer system 150 is configured to supply thermal energy 501 to the fluid mixture 505 during the drying process, and to thereby adapt or control the evaporation rate of the first component, such that the temperature T of the fluid mixture 505 on the surface of the substrate 120 rises to a temperature of 65% or more (or 70% or more, or 80% or more) of the boiling temperature $T_S$ of the first component in a first phase (or in an initial phase) of the drying process, whereas the proportion g of the second component in the fluid mixture 505 on the surface of the substrate 120 rises (only) by 10 percentage points to 30 percentage points, starting from an initial proportion. The initial proportion of the second component in the fluid mixture 505 may be 25% or less. The proportion g of the second component in the fluid mixture 505 may be 40% or less at the end of the second phase.

Furthermore, thermal energy 501 may be supplied, and the evaporation rate of the first component thereby adapted, such that the temperature T of the fluid mixture 505 is at 65% or more (or 70% or more, or 80% or more) of the boiling temperature $T_S$ of the first component in a second phase (or in a main phase) of the drying process, whereas the proportion g of the second component in the fluid mixture 505 is increased to 95% or more.

In particular, thermal energy 501 may be supplied to the fluid mixture 505, and/or the evaporation rate of the first component may be adapted, such that the duration of the second phase is longer than the duration of the first phase (in particular by a factor of 1.2 or more). Alternatively or additionally, the drying process may be controlled such that the duration of the second phase is 25% or more, in particular 50% or more, of the total drying duration of the drying process. A particularly reliable and complete absorption of the second component in the substrate 120 may thus be produced.

The drying process may be controlled such that the temperature T of the fluid mixture 505 is kept below the boiling temperature of the first component within the first and/or second phase. The evaporation rate may thus be kept relatively low within the second phase (in order to increase the proportional duration of the second phase in the total drying duration of the drying process).

In an exemplary embodiment, the dryer system 150 is configured to supply thermal energy 501 to the fluid mixture 505 during the drying process, and to adapt the evaporation rate of the first component, such that the temperature T of the fluid mixture 505 is increased beyond the boiling temperature $T_S$ of the first component in a third phase of the drying process. A complete evaporation of the first component from the fluid mixture 505 may thus be reliably produced. Furthermore, a further absorption of the second component into the substrate 120 may thus be produced. A cooling of the substrate 120 may then take place following the third phase of the drying process.

In an exemplary embodiment, the dryer system 150 is configured to produce a drying process having a plurality of different drying phases. In a first phase, the temperature T of the fluid mixture 505 may thereby be increased relatively quickly (for example to 65% or more, or 70% or more, or 80% or more of the boiling temperature $T_S$ of the first component). In a second phase, a drying takes place at relatively high temperature T of the fluid mixture 505 (for example between 65% and 95% of the boiling temperature $T_S$ of the first component) with one or more drying methods that produce a relatively low evaporation rate of the first component. The duration of the second phase, in which a relatively stark absorption of the second component into the substrate 120 takes place, may thus be extended. In a final third phase, a remaining evaporation of the first component and a further absorption of the second component may then be produced via optional additional heating to a temperature T above the boiling temperature $T_S$ of the first component.

In an exemplary embodiment, the dryer system 150 includes a plurality of different dryers 160, 170, 180 that are configured to use different drying methods in different phases of a drying process in order to produce a defined curve 304 of the combination of temperature T and proportion g of the second component during the drying process. In an exemplary embodiment, the dryer system 150 includes at least one convection dryer 160 that is configured to blow a tempered drying medium 164 onto the fluid mixture 505 in order to supply thermal energy 501 to the fluid mixture 505. Alternatively or additionally, in an exemplary embodiment, the dryer system 150 includes at least one radiant dryer 180 that is configured to expose the fluid mixture 505 with a radiation 185 in order to supply thermal energy 501 to the fluid mixture 505. Alternatively or additionally, in an exemplary embodiment, the dryer system 150 includes at least one thermal conductivity dryer 170 that is configured to heat the back side of the substrate 120 in order to supply thermal energy 501 to the fluid mixture 505.

In an exemplary embodiment, the dryer system 150 is configured to direct the substrate 120 past the at least one convection dryer 160, past the at least one radiant dryer 180, and/or past the at least one thermal conductivity dryer 170 in order to supply thermal energy 501 to the fluid mixture 505 during the drying process. Via the arrangement of different dryers 160, 170, 180 along a drying route, a defined target curve 304 for operating points made up of temperature T and proportion g of the second component during a drying process may be particularly reliably set in order to produce, on average, an optimally high value of the absorption variable A for the second component (for example on average 30%, 40%, or more of the maximum value $A_{max}$ of the absorption variable A) during the drying process.

In an exemplary embodiment, the dryer system 150 includes at least one temperature sensor 166, 186 that is configured to detect temperature data in relation to the temperature T of the fluid mixture 505 during a drying process. In particular, a plurality of temperature sensors 166, 186 may be arranged along the drying route of the dryer system 150 in order to detect the (time) curve of the temperature T during a drying process.

Furthermore, in an exemplary embodiment, the dryer system 150 is configured to determine proportion data in relation to the proportion g of the second component in the fluid mixture 505 during the drying process. For example, measurement data in relation to the moisture in the ambient air around the fluid mixture 505 may be detected using one or more moisture sensors that are arranged along the drying route of the dryer system 150. The evaporation of the first component, and therefore the proportion g of the second component in the fluid mixture 505, may be concluded from the measurement data (by means of a model). A (time) curve of the proportion g of the second component in the fluid mixture 505 may thus be detected and/or determined during a drying process.

In an exemplary embodiment, the dryer system 150 is also configured to adapt thermal energy 501 supplied to the fluid mixture 505 during the drying process depending on the temperature data and depending on the proportion data. In particular, one or more operating parameters of one or more dryers 160, 170, 180 may be adapted. Examples of operating parameters are

- the temperature and/or the moisture and/or the flow rate of the drying medium 164;
- the intensity and/or the spectrum of the radiation 184; and/or
- the temperature of a heating saddle.

By adapting the supplied thermal energy 501, in particular by adapting the time curve of the energy supply, relatively high values of the absorption variable A may be particularly reliably set during a drying process.

Using the measures described in this document, the absorption of a relatively viscous fluid component (in particular a cosolvent in ink) may be accelerated and/or improved. This enables the quality of a fixed ink-based print image to be increased. Furthermore, the length of a drying route of a dryer system 150 may be reduced via the described measures.

CONCLUSION

The aforementioned description of the specific embodiments will so fully reveal the general nature of the disclosure that others can, by applying knowledge within the skill of the art, readily modify and/or adapt for various applications such specific embodiments, without undue experimentation, and without departing from the general concept of the present disclosure. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

References in the specification to "one embodiment," "an embodiment," "an exemplary embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The exemplary embodiments described herein are provided for illustrative purposes, and are not limiting. Other exemplary embodiments are possible, and modifications may be made to the exemplary embodiments. Therefore, the specification is not meant to limit the disclosure. Rather, the scope of the disclosure is defined only in accordance with the following claims and their equivalents.

Embodiments may be implemented in hardware (e.g., circuits), firmware, software, or any combination thereof. Embodiments may also be implemented as instructions stored on a machine-readable medium, which may be read and executed by one or more processors. A machine-readable medium may include any mechanism for storing or transmitting information in a form readable by a machine (e.g., a computer). For example, a machine-readable medium may include read only memory (ROM); random access memory (RAM); magnetic disk storage media; optical storage media; flash memory devices; electrical, optical, acoustical or other forms of propagated signals (e.g., carrier waves, infrared signals, digital signals, etc.), and others. Further, firmware, software, routines, instructions may be described herein as performing certain actions. However, it should be appreciated that such descriptions are merely for convenience and that such actions in fact results from computing devices, processors, controllers, or other devices executing the firmware, software, routines, instructions, etc. Further, any of the implementation variations may be carried out by a general purpose computer.

For the purposes of this discussion, the term "processor circuitry" shall be understood to be circuit(s), processor(s), logic, or a combination thereof. A circuit includes an analog circuit, a digital circuit, state machine logic, data processing circuit, other structural electronic hardware, or a combination thereof. A processor includes a microprocessor, a digital signal processor (DSP), central processor (CPU), application-specific instruction set processor (ASIP), graphics and/or image processor, multi-core processor, or other hardware processor. The processor may be "hard-coded" with instructions to perform corresponding function(s) according to aspects described herein. Alternatively, the processor may access an internal and/or external memory to retrieve instructions stored in the memory, which when executed by the processor, perform the corresponding function(s) associated with the processor, and/or one or more functions and/or operations related to the operation of a component having the processor included therein.

In one or more of the exemplary embodiments described herein, the memory is any well-known volatile and/or non-volatile memory, including, for example, read-only memory (ROM), random access memory (RAM), flash memory, a magnetic storage media, an optical disc, erasable programmable read only memory (EPROM), and programmable read only memory (PROM). The memory can be non-removable, removable, or a combination of both.

REFERENCE LIST

1 transport direction
21, 22 nozzle (print image)
31, 32 column (of the print image)
100 printing device (printer)
101 controller
102 print bar
103 print head
120 substrate (recording medium)
140 print group
150 fixing or dryer system
160 convection dryer
161 controller
162 heating element
163 nozzle
164 tempered drying medium (fluid, in particular air)
165 blower
166 temperature sensor
170 thermal conductivity dryer
180 radiant dryer
181 controller
183 radiation source
184 radiation
186 temperature sensor
300 characteristic data
g proportion of the second component (cosolvent) in a fluid mixture
T temperature
$T_S$ boiling temperature of the first component (water)
303 isolines for identical values of the absorption variable
304 curve of the combinations of temperature and proportion of the second component during a drying process
A absorption variable
311 curve of the absorption variable as a function of the proportion of the second component
321-323 points in time
330 dryers along a drying route
341 time curve of the mass of the first component (for example water)
342 time curve of the mass of the second component (for example cosolvent)
400 method for drying a fluid mixture
401, 402 method steps
500 ink layer
501, 502 thermal energy
503 pores
504 absorbed fluid mixture
505 fluid mixture (on the surface of the substrate)

The invention claimed is:

1. A method of a drying process for drying a fluid mixture on a surface of a substrate having pores configured to absorb the fluid mixture, the fluid mixture including a first component having a first viscosity and a second component having a second viscosity higher than the first viscosity, the first component having a higher evaporation rate than the second component, the method comprising:

supplying thermal energy to the fluid mixture; and adapting an evaporation rate of the first component during the drying process to reduce a quantity of the second component remaining on the surface of the substrate following the drying process, wherein:

in a first phase of the drying process, a temperature of the fluid mixture on the surface of the substrate increases to greater than 65% and less than 100% of a boiling temperature of the first component, wherein a proportion of the second component in the fluid mixture on the surface of the substrate increases, starting from an initial proportion, by 10 to 30%; and in a second phase of the drying process, the temperature of the fluid mixture is more than 65% and less than 100% of the boiling temperature of the first component, wherein the proportion of the second component in the fluid mixture is increased to 95% or more.

2. The method according to claim 1, wherein the thermal energy is supplied to the fluid mixture, and the evaporation rate of the first component is adapted, such that:

a duration of the second phase is longer than a duration of the first phase; or a duration of the second phase is 25% or more of a total drying duration of the drying process.

3. The method according to claim 1, wherein the thermal energy is supplied to the fluid mixture, and the evaporation rate of the first component is adapted, such that:

a duration of the second phase is longer than a duration of the first phase; and a duration of the second phase is 25% or more of a total drying duration of the drying process.

4. The method according to claim 1, wherein:

the initial proportion of the second component in the fluid mixture is 25% or less; or the proportion of the second component in the fluid mixture is 40% or less at a beginning of the second phase.

5. The method according to claim 1, wherein:

the initial proportion of the second component in the fluid mixture is 25% or less; and the proportion of the second component in the fluid mixture is 40% or less at a beginning of the second phase.

6. The method according to claim 1, wherein the thermal energy is supplied to the fluid mixture and the evaporation rate of the first component is adapted such that:

in a third phase of the drying process, the temperature of the fluid mixture is increased above the boiling temperature of the first component; and a cooling of the substrate takes place following the third phase of the drying process.

7. The method according to claim 1, wherein:

the thermal energy is supplied to the fluid mixture and the evaporation rate of the first component is adapted such that, in the second phase, the temperature of the fluid mixture and the proportion (g) of the second component in the fluid mixture on the surface of the substrate are at least temporarily held in a value range in which an absorption variable is above a minimum value;

the absorption variable depends on $g/\sqrt{\eta}$;

$\eta$ is the viscosity of the fluid mixture on the surface of the substrate; and the viscosity of the fluid mixture depends on the temperature of the fluid mixture and on the proportion (g) of the second component in the fluid mixture.

8. The method according to claim 7, wherein:

the absorption variable has a reference value at the boiling temperature; and the thermal energy is supplied to the fluid mixture such that a minimum value of the absorption variable is 70% or more of the reference value of the absorption variable, the absorption variable exceeding the minimum value for a minimum time portion of the total drying duration of the drying process.

9. The method according to claim 1, further comprising:

adapting a moisture of gas in a direct environment of the fluid mixture on the surface of the substrate during the drying process; or using different drying methods to dry the fluid mixture on the surface of the substrate during the drying process, the different drying methods having different evaporation rates for the first component, wherein the different drying methods include:

drying using a tempered drying medium that acts on a back side and/or on a front side of the substrate;

drying using radiation; and/or drying via heating of the back side of the substrate using a heating saddle that contacts the back side of the substrate.

10. The method according to claim 1, further comprising:

adapting a moisture of gas in a direct environment of the fluid mixture on the surface of the substrate during the drying process; and using different drying methods to dry the fluid mixture on the surface of the substrate during the drying process, the different drying methods having different evaporation rates for the first component, wherein the different drying methods include:

drying using a tempered drying medium that acts on a back side and/or on a front side of the substrate;

drying using radiation; and/or drying via heating of the back side of the substrate using a heating saddle that contacts the back side of the substrate.

11. The method according to claim 1, wherein:

the fluid mixture comprises ink;

the substrate is a recording medium;

the first component comprises water; and the second component comprises a cosolvent.

12. A non-transitory computer-readable storage medium with an executable program stored thereon, that when executed, instructs a processor to perform the method of claim 1.

13. A dryer system for drying a fluid mixture on a surface of a substrate using a drying process, the substrate having pores configured to absorb the fluid mixture, the fluid mixture including a first component having a first viscosity and a second component having a second viscosity higher than the first viscosity, wherein the first component has a higher evaporation rate than the second component, the dryer system comprising:

at least one dryer configured to supply thermal energy to the fluid mixture during the drying process; and a controller configured to control the at least one dryer to adapt an evaporation rate of the first component, wherein:

in a first phase of the drying process, a temperature of the fluid mixture on the surface of the substrate increases to greater than 65% and less than 100% of a boiling temperature of the first component, wherein a proportion of the second component in the fluid mixture on the surface of the substrate increases, starting from an initial proportion, by 10 to 30%; and in a second phase of the drying process, the temperature of the fluid mixture is more than 65% and less than 100% of the boiling temperature of the first component, wherein the proportion of the second component in the fluid mixture is increased to 95% or more.

* * * * *